US007518955B2

(12) United States Patent
Saukkonen

(10) Patent No.: US 7,518,955 B2
(45) Date of Patent: Apr. 14, 2009

(54) ELECTRONIC DEVICE AND METHOD FOR ENHANCING USABILITY OF ELECTRONIC DEVICE

(75) Inventor: Topi Saukkonen, Oulunsalo (FI)

(73) Assignee: Nokia Corporation, Espoo (FI)

( * ) Notice: Subject to any disclaimer, the term of this patent is extended or adjusted under 35 U.S.C. 154(b) by 462 days.

(21) Appl. No.: 10/961,419

(22) Filed: Oct. 8, 2004

(65) Prior Publication Data

US 2006/0077763 A1 Apr. 13, 2006

(51) Int. Cl.
*G04B 47/00* (2006.01)
*G04C 17/00* (2006.01)
*G04C 21/00* (2006.01)

(52) U.S. Cl. ..... 368/10; 368/29; 368/73

(58) Field of Classification Search ..... 368/28, 368/107–109, 111, 10, 29, 73–74, 250, 251
See application file for complete search history.

(56) References Cited

U.S. PATENT DOCUMENTS 3,999,050 A * 12/1976 Pitroda ..... 708/112
4,774,697 A * 9/1988 Aihara ..... 368/41
5,220,540 A * 6/1993 Nishida et al. ..... 368/41
5,361,241 A * 11/1994 Ferrara et al. ..... 368/281
5,861,797 A * 1/1999 Becker ..... 340/309.3
6,266,295 B1 * 7/2001 Parker et al. ..... 368/28
6,414,907 B1 * 7/2002 Pennington ..... 368/10
6,477,117 B1 * 11/2002 Narayanaswami et al. .. 368/251
6,943,671 B2 * 9/2005 McGee et al. ..... 340/384.71

* cited by examiner

*Primary Examiner*—Vit W Miska
(74) *Attorney, Agent, or Firm*—Hollingsworth & Funk, LLC

(57) ABSTRACT

An electronic device is provided, the device comprising a display, user interface, a controlling unit connected to the display and the user interface, providing an electronic calendar application and an alarm clock application. The device further comprises a memory connected to the controlling unit to store calendar items. The controlling unit is configured to receive a command from the user interface of the device to set an alarm to a given time; set the alarm to said time; activate an alarm on the display of the device at said time, receive a stop alarm command from the user interface of the device; stop the alarm and activate and display the calendar application and/or a task list for the date of the alarm.

15 Claims, 2 Drawing Sheets

ELECTRONIC DEVICE AND METHOD FOR ENHANCING USABILITY OF ELECTRONIC DEVICE

FIELD

Figure 1:
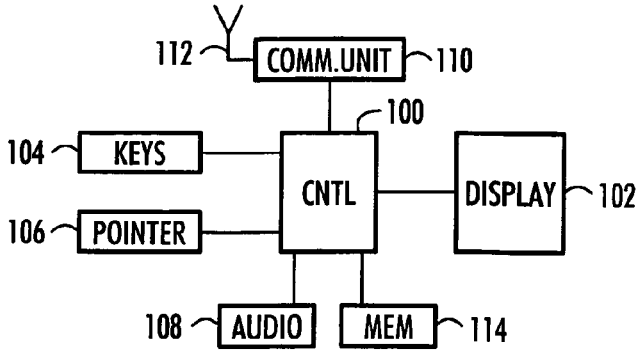

The invention relates to a method for enhancing the usability of an electronic device comprising an alarm function.

BACKGROUND

Many modern electronic devices, such as terminal equipment, personal computers and portable personal digital assistants (PDA), include several useful applications for the users. These versatile devices may thus be used as notebooks, electronic calendars and alarm clocks. The users of these devices do not need separate devices or accessories for each purpose.

The user friendliness and usability of the user interface of these devices, terminal equipment and PDAs in particular, has increased in recent years but there is still need for improvements especially in the interoperation of separate applications.

BRIEF DESCRIPTION OF THE INVENTION

An object of the invention is to provide an improved solution for enhancing usability of electronic devices. According to an aspect of the invention, there is provided a method for enhancing the usability of an electronic device, the method comprising: receiving a command to set an alarm to a given time; setting the alarm to said time; activating the alarm at said time; receiving a stop alarm command; stopping the alarm and activating and displaying a calendar application for the date of the alarm.

According to another aspect of the invention, there is provided an electronic device comprising a display; user interface; a controlling unit connected to the display and the user interface, providing an electronic calendar application and an alarm clock application; a memory connected to the controlling unit to store calendar items; the controlling unit being configured to receive a command from the user interface of the device to set an alarm to a given time; set the alarm to said time; activate an alarm on the display of the device at said time; receive a stop alarm command from the user interface of the device; stop the alarm and activate and display the calendar application for the date of the alarm.

According to another aspect of the invention, there is provided an electronic device comprising: displaying means for controlling a display; interfacing means for receiving commands from the user of the device; controlling means operationally connected to the displaying means and to the interfacing means, providing an electronic calendar application and an alarm clock application; memory means connected to the controlling means to store calendar items; the controlling means being configured to set an alarm to a given time after receiving a respective command from the interfacing means; send a command to the displaying means to activate an alarm at said time; receive a stop alarm command from the user interface of the device; stop the alarm and activate and display the calendar application for the date of the alarm after receiving a stop alarm command from the interfacing means.

The invention provides several advantages. According to the solution provided by the invention, when a user deactivates an alarm clock application, the calendar of the day will be automatically activated and displayed. Thus, the user does not need to select the calendar application separately to view the day's program. For example, the user is able to view tasks scheduled for the day without any additional commands in the morning after the device has provided a wake-up alarm.

LIST OF DRAWINGS

Figure 2A:
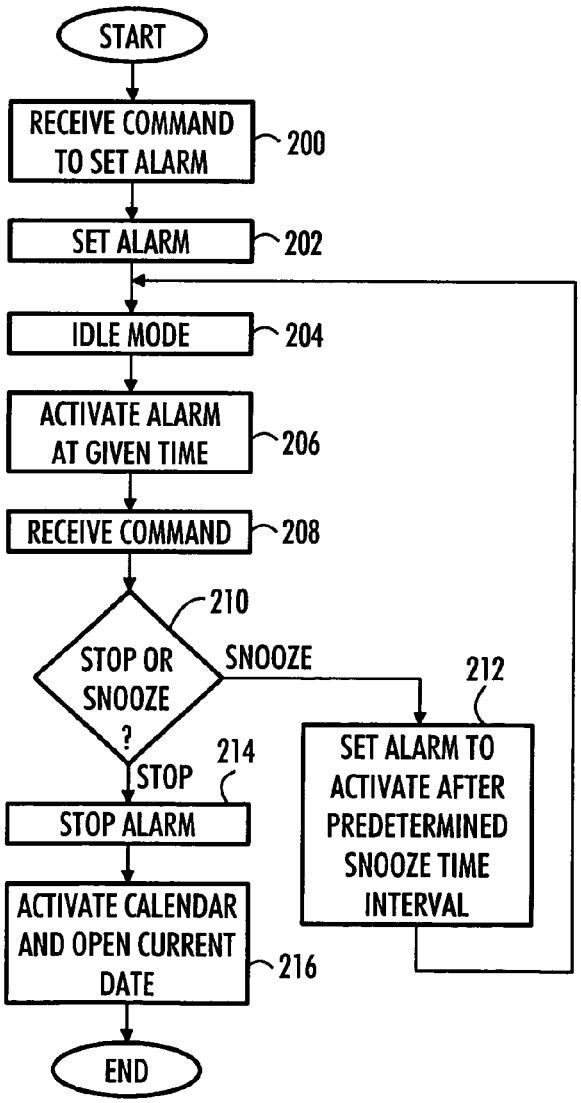
Figure 3A:
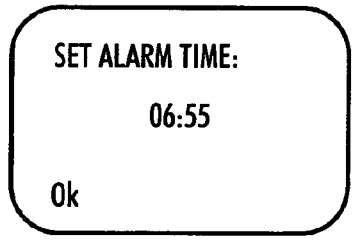
Figure 3B:
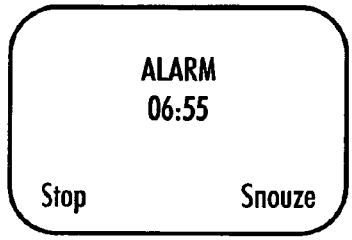
Figure 3C:
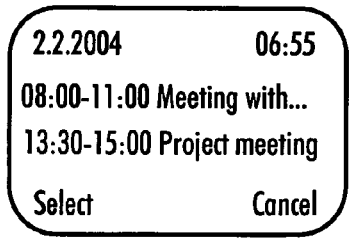
Figure 2B:
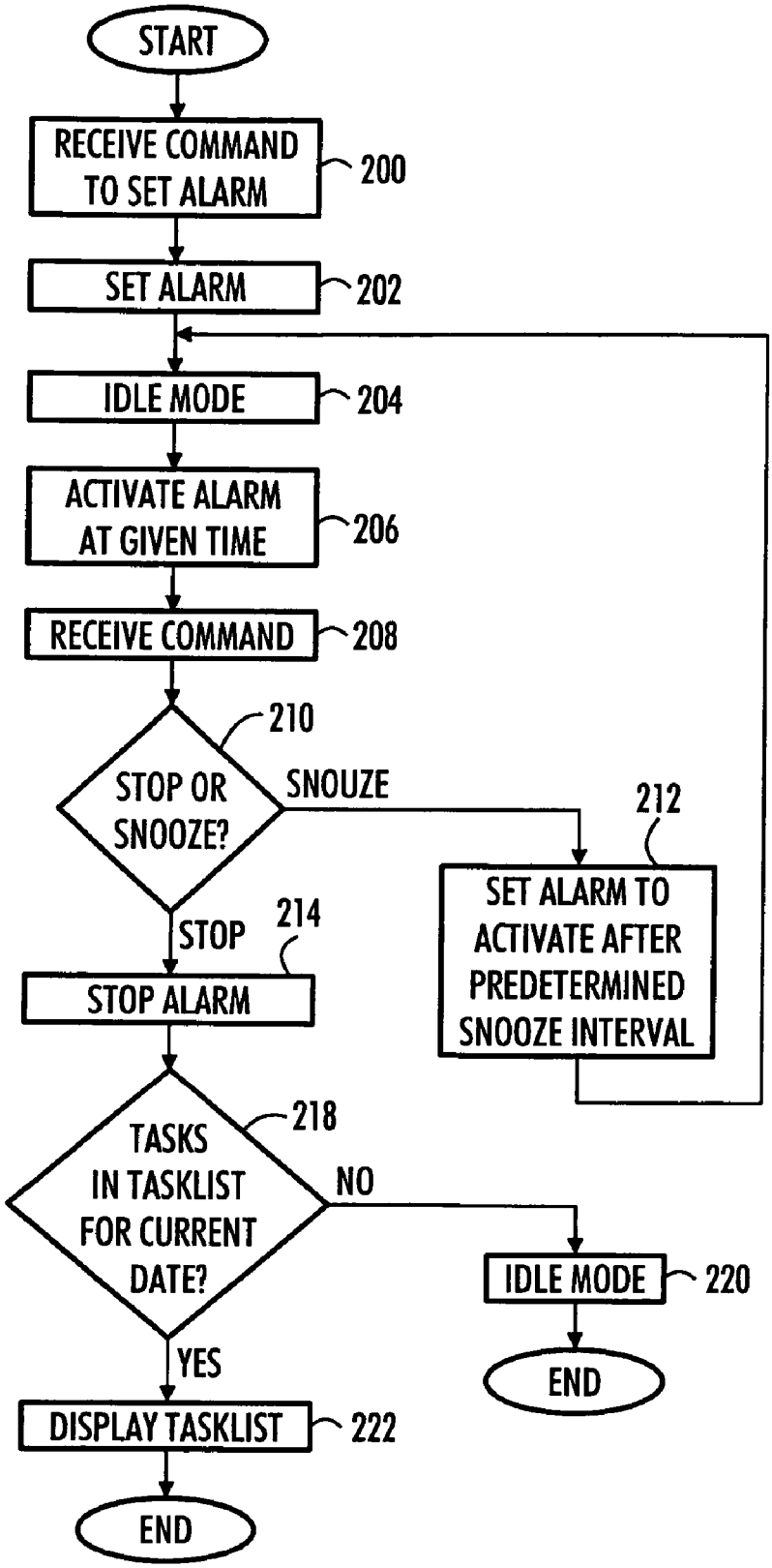

In the following, the invention will be described in greater detail with reference to the embodiments and the accompanying drawings, in which FIG. 1 shows an example of an electronic device of an embodiment;

FIGS. 2A and 2B illustrate embodiments of the invention with a flowchart; and FIGS. 3A to 3C illustrate an embodiment of the invention.

DESCRIPTION OF EMBODIMENTS

With reference to FIG. 1, examine an example of an electronic device to which embodiments of the invention can be applied. The electronic device comprises a controlling unit 100, typically implemented with a microprocessor, a signal processor or separate components and associated software. The device further comprises a display 102 connected to the controlling unit 100. The display is typically configured to display graphics and text. The device comprises a user interface, which may be realized with a keyboard 104. The keyboard is connected to the controlling unit 100. In an embodiment, the keyboard is realized using a touch sensitive display 102. In such a case, there may not be a separate keyboard. The user interface may also comprise a pointer device 106, with which commands may be given to the device. The pointer device may be a mouse, a touch pad or any other corresponding input device, as one skilled in the art is aware.

The device may also comprise an audio interface 108, which typically comprises a microphone and a loudspeaker. The device may also comprise a memory 114 for storing for example telephone numbers, calendar data and other user-specific data. In an embodiment, the device may also comprise a communication unit 110 implementing the functions of terminal equipment including speech and channel coders, modulators and RF parts. In some embodiments, the device may also comprise an antenna 112.

The communication unit 110 may also be realized with a Wireless Local Area Network (WLAN) transceiver or a short-range communication transceiver implemented with a Bluetooth chip, for example. The communication unit 110 may also be a network adapter, with which the device may be connected to a network.

The controlling unit 100 controls the operation of the device. The controlling unit may be configured to run an operating system which includes routines handling the user interface and other parts of the device. The operating system is configured to execute other applications based on commands received from the user interface. Such applications are an electronic calendar application, an alarm clock application and a task list application, for example.

The electronic device may be a personal computer, a mobile telephone or a PDA (Personal Digital Assistant) device, for example. The device may also be a unit in multipart user equipment. User equipment divided into several parts that are used in various combinations is recently being developed. Multipart user equipment or multipart radio terminals may, for example, include a small cellular core unit and a number of optimised peripheral units. The core unit of the multipart radio terminal controls the operation of the whole device. The core unit handles connections to the outside world on behalf of the peripheral units. The peripheral units of the multipart terminals are optimised for specific tasks and all the peripheral units are connected to a core unit by a wireless connection. One of the peripheral units may provide a user interface with a display and another peripheral unit may be optimised for messaging and browsing or for imaging and music, for example. The electronic device of the invention may be a core unit or a peripheral unit or a combination of units, as one skilled in the art is aware.

With reference to FIGS. 2A and 3A to 3C, examine an embodiment of the invention. In step 200, the controlling unit receives a command to set an alarm to a given time. When the user has issued a command to set an alarm, the controlling unit initiates a routine which inquires the user for the time of the alarm. FIG. 3A illustrates the inquiry. The user may type the time when the alarm should be activated and finish the command by selecting the Ok button. The routine may also inquire the date of the alarm.

In step 202, the controlling unit sets the alarm to the given date and time. The information regarding the alarm may be stored in the memory 114 of the device.

In step 204, the device enters idle mode after setting the alarm. In idle mode the device is waiting commands from the user. The controlling unit runs a routine monitoring the date and time and the stored alarms. This may be performed using routines known to one skilled in the art.

In step 206, the controlling unit detects that the date and time of the alarm occurs. The controlling unit activates the alarm as displayed in FIG. 3B, for example. The alarm may also comprise an audible alarm. The displayed alarm may comprise a query whether to stop the alarm or to snooze for a predetermined time period, for example for 5 minutes.

In step 208, the controlling unit receives a command from the user interface.

In step 210, the controlling unit checks whether the command was to stop the alarm or to snooze.

If the command was to snooze, the controlling unit sets in step 212 the alarm to activate after a predetermined time period has elapsed and enters idle mode. The procedure continues from 204.

If the command was to stop the alarm, the controlling unit stops the alarm in step 214.

In step 216, the controlling unit activates calendar application and displays the current date, as FIG. 3C illustrates.

Thus the user can immediately see the agenda of the day without any additional commands.

With reference to FIG. 2B, examine another embodiment of the invention. Regarding steps 200 to 206, the description related to FIG. 2A is referred.

In step 208, the controlling unit receives a command from the user interface.

In step 210, the controlling unit checks whether the command was to stop the alarm or to snooze.

If the command was to snooze, the controlling unit sets in step 212 the alarm to activate after a predetermined time period has elapsed and enters idle mode. The procedure continues from 204.

If the command was to stop the alarm, the controlling unit stops the alarm in step 214.

In step 218, the controlling unit activates a task list application or a calendar application responsible for keeping a task list and checks if the task list kept by the task list application includes tasks for the current date. If this is not the case, the controlling unit enters idle mode in step 220. If the task list includes tasks for the current date, the controlling unit displays the task list for the current date in step 222.

Thus the user can immediately see the tasks scheduled for the current day without any additional commands.

In an embodiment, the controlling unit does not determine whether the task list is empty or whether it includes tasks for the current date. The task list is displayed regardless of the number of the tasks.

In an embodiment, the controlling unit is configured to display both the calendar application and the task list when the alarm occurs. Thus, the user is able to get a complete picture of the activities and tasks scheduled for the day.

When the invention is realized in multipart equipment, the controlling unit and the display may be in different units of the multipart equipment. In such a case, the controlling unit may not necessarily directly control the display. It may send display instructions to the controller of the peripheral comprising the display, as one skilled in the art is aware.

In an embodiment, the invention is realized as a computer program product encoding a computer program of instructions for executing a computer process in an electronic device for enhancing the usability of the device.

In an embodiment, the invention is realized as a computer program distribution medium readable by a computer and encoding a computer program of instructions for executing a computer process in an electronic device for enhancing the usability of the device. The process comprises receiving a command to set an alarm to a given time; setting the alarm to said time; activating the alarm at said time; receiving a stop alarm command; stopping the alarm and activating and displaying a calendar application for the date of the alarm.

The distribution medium may comprise a computer readable medium, a program storage medium, a record medium, a computer readable memory, a computer readable software distribution package, a computer readable signal, a computer readable telecommunications signal, and a computer readable compressed software package, for example.

Even though the invention is described above with reference to an example according to the accompanying drawings, it is clear that the invention is not restricted thereto but it can be modified in several ways within the scope of the appended claims.

The invention claimed is:

1. A method for enhancing the usability of an electronic device, the method comprising:

receiving a command to set an alarm to a given time;

setting the alarm to said time;

activating the alarm at said time;

receiving a stop alarm command; and in response to stopping the alarm, activating and displaying a calendar application for the date of the alarm.

2. The method of claim 1, further comprising:

receiving a snooze command after activating the alarm; and setting the alarm to activate after a predetermined time and entering idle mode.

3. A method for enhancing the usability of an electronic device, the method comprising:

receiving a command to set an alarm to a given time;

setting the alarm to said time;

activating the alarm at said time;

receiving a stop alarm command; and in response to stopping the alarm, displaying a task list for the date of the alarm.

4. The method of claim 3, further comprising:

checking whether the task list comprises tasks on the date of the alarm; and displaying the task list only if the task list is not empty.

5. An electronic device comprising:

a display, user interface, a controlling unit connected to the display and the user interface, providing an electronic calendar application and an alarm clock application, a memory connected to the controlling unit to store calendar items, the controlling unit being configured to receive a command from the user interface of the device to set an alarm to a given time;

set the alarm to said time;

activate an alarm on the display of the device at said time, receive a stop alarm command from the user interface of the device; and stop the alarm and in response to stopping the alarm, activate and display the calendar application for the date of the alarm.

6. The electronic device of claim 5, wherein the activated alarm comprises a query whether to stop the alarm or to snooze.

7. The electronic device of claim 5, wherein the controlling unit is configured to display both a calendar application and a task list application on the display of the device.

8. An electronic device comprising:

a display;

user interface;

a controlling unit connected to the display and the user interface, providing a task list application and an alarm clock application;

a memory connected to the controlling unit to store calendar items, the controlling unit being configured to receive a command from the user interface of the device to set an alarm to a given time;

set the alarm to said time;

activate an alarm on the display of the device at said time;

receive a stop alarm command from the user interface of the device; and stop the alarm and in response to stopping the alarm, display the task list for the date of the alarm.

9. The electronic device of claim 8, wherein the controlling unit is further configured to receive a snooze command from the user interface of the device as a response to the activated alarm;

set the alarm to activate after a predetermined time on the basis of the snooze command; and enter idle mode.

10. The electronic device of claim 8, wherein the controlling unit is further configured to check whether the task list comprises tasks on the date of the alarm; and display the task list only if the task list is not empty.

11. The electronic device of claim 8, wherein the controlling unit is configured to display both a calendar application and a task list application on the display of the device.

12. An electronic device comprising:

displaying means for controlling a display;

interfacing means for receiving commands from the user of the device;

controlling means operationally connected to the displaying means and to the interfacing means, providing an electronic calendar application and an alarm clock application;

memory means connected to the controlling means to store calendar items; the controlling means being configured to set an alarm to a given time after receiving a respective command from the interfacing means;

send a command to the displaying means to activate an alarm at said time;

receive a stop alarm command from the user interface of the device; and stop the alarm and in response to stopping the alarm, activate and display the calendar application for the date of the alarm, after receiving a stop alarm command from the interfacing means.

13. A computer program product encoding a computer program of instructions for executing a computer process in an electronic device for enhancing the usability of the device, the process comprising:

receiving a command to set an alarm to a given time;

setting the alarm to said time;

activating the alarm at said time;

receiving a stop alarm command; and in response to stopping the alarm, activating and displaying a calendar application for the date of the alarm.

14. A computer program distribution medium readable by a computer and encoding a computer program of instructions for executing a computer process in an electronic device for enhancing the usability of the device, the process comprising:

receiving a command to set an alarm to a given time;

setting the alarm to said time;

activating the alarm at said time;

receiving a stop alarm command; and in response to stopping the alarm, activating and displaying a calendar application for the date of the alarm.

15. The computer program distribution medium of claim 14, the distribution medium comprising a computer readable medium, a program storage medium, a record medium, a computer readable memory, a computer readable software distribution package, a computer readable signal, a computer readable telecommunications signal, and a computer readable compressed software package.

* * * * *